United States Patent [19]

Tarr

[11] 4,139,914

[45] Feb. 20, 1979

[54] SECURITY POCKET

[76] Inventor: Allan L. Tarr, Box 521, Marion, Va. 24354

[21] Appl. No.: 893,387

[22] Filed: Apr. 5, 1978

Related U.S. Application Data

[63] Continuation-in-part of Ser. No. 791,542, Apr. 27, 1977, abandoned.

[51] Int. Cl.[2] ..... A41D 27/20

[52] U.S. Cl. ..... 2/247

[58] Field of Search ..... 2/247, 251, 254, 227

[56] References Cited

U.S. PATENT DOCUMENTS

| | | | |
|---|---|---|---|
| 1,651,921 | 12/1927 | Felz | 224/26 |
| 2,474,495 | 6/1949 | Pollak | 2/247 |
| 2,825,068 | 3/1958 | Montgomery | 2/247 |

*Primary Examiner*—Werner H. Schroeder
*Assistant Examiner*—Doris L. Troutman
*Attorney, Agent, or Firm*—Charles L. Gholz

[57] ABSTRACT

Disclosed is a security pocket adapted to be worn on the inside of a pair of pants. The security pocket comprises a pouch having an opening sized to permit access to the interior of the pouch and means for releasably mounting the pouch on the inside of a pair of pants. Two general types of such means are disclosed. The first general type is hung from the belt and passes over the top of the waistband; the second general type is releasably attached to the inside of the pants themselves.

8 Claims, 10 Drawing Figures

FIG. 1
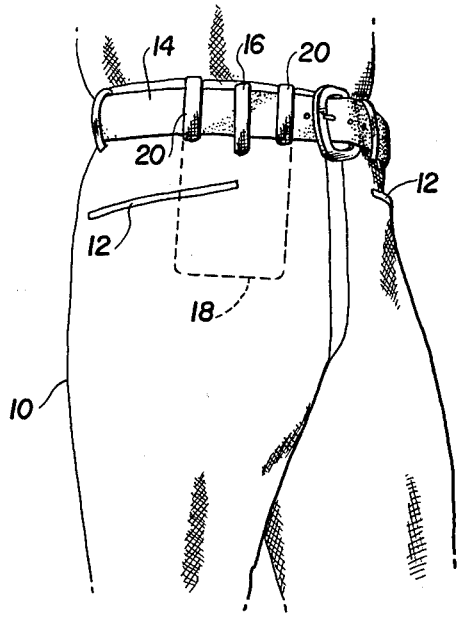
FIG. 2
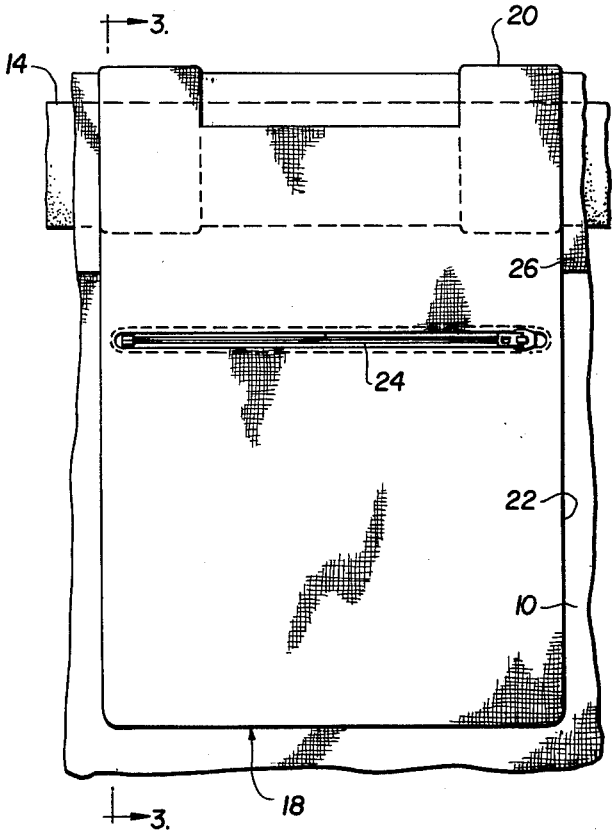
FIG. 3
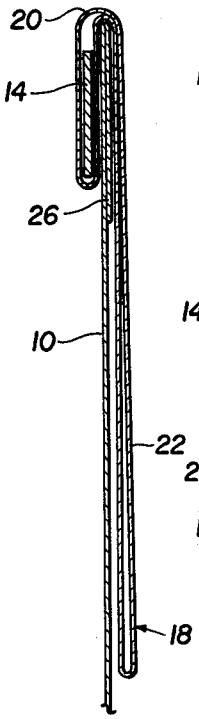
FIG. 5
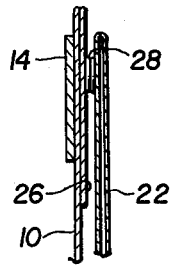
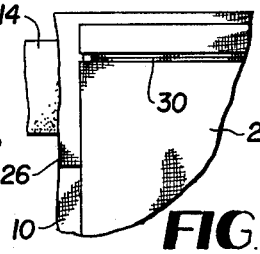
FIG. 6
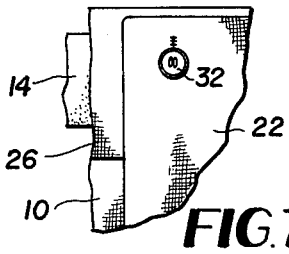
FIG. 7
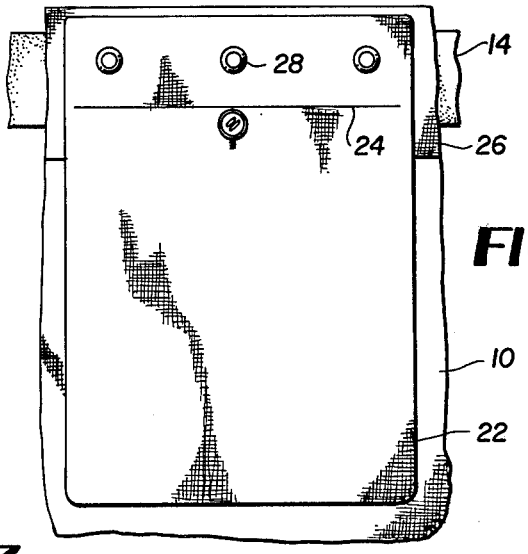
FIG. 4

SECURITY POCKET

CROSS-REFERENCE TO RELATED APPLICATION

This application is a continuation-in-part of application Ser. No. 791,542, filed Apr. 27, 1977, and abandoned upon the filing of the present application.

BACKGROUND OF THE INVENTION

This invention relates to security pockets such as are commonly permanently mounted in the inside of men's suit coats and sports jackets. As is well known, such pockets are much more difficult to pick than are conventional pockets in which access is gained from the outside of the garment.

In addition to the common security pocket in men's suit coats and sport jackets, various fairly elaborate, permanently installed security pocket for pants are also known. Exemplary of these is the pocket shown in U.S. Pat. No. 2,498,048, issued on Feb. 21, 1950, to Heinken. These pockets, however, suffer from the drawback that they are permanently installed, adding to the bulk of the garment, while the need for their use is only intermittent. Additionally, valuables stored in those pockets must either be removed therefrom or the entire pair of pants carried around with the wearer or stored in a safe place when the pants are removed—as, for instance, when the wearer goes to bed or goes to take a bath outside his bedroom, such as in many foreign hotels or other lodging places.

The problems suggested in the preceding paragraph are not intended to be exhaustive, but rather are among many which tend to reduce the usefulness of prior security pockets. Other noteworthy problems may also exist; however, those presented above should be sufficient to demonstrate that such security pockets have not been altogether satisfactory.

OBJECTS OF THE INVENTION

It is, therefore, a general object of the invention to provide security pockets which will obviate or minimize problems of the type previously described.

It is a particular object of the invention to provide security pockets which may be easily removed from the pants either when the security pocket is not needed or when it is desired to carry or store the security pocket separately from the pants.

Other objects and advantages of the present invention will become apparent from the following detailed description of several preferred embodiments thereof taken in conjunction with the accompanying drawings.

BRIEF DESCRIPTION OF THE DRAWINGS

FIG. 1 is a perspective view of a person wearing a first embodiment of the subject invention.

FIG. 2 is a view from the inside of the pants showing the first embodiment of the subject invention.

FIG. 3 is a view along the line 3—3 in FIG. 2.

FIG. 4 is a view from the inside of the pants showing a second embodiment of the subject invention.

FIG. 5 is a view along the line 5—5 in FIG. 4.

FIG. 6 is a fragmentary view of a third embodiment of the subject invention.

FIG. 7 is a fragmentary view of a fourth embodiment of the subject invention.

DETAILED DESCRIPTION OF THE PRESENTLY PREFERRED EMBODIMENT

Figure 8:
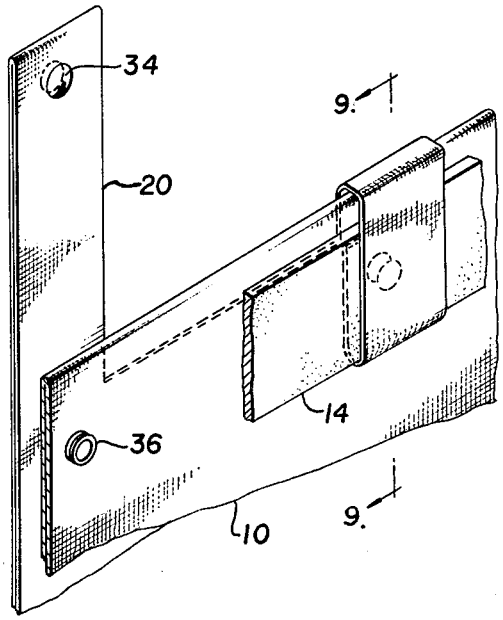
FIG. 8 is a fragmentary view of a fifth embodiment of the subject invention.

Referring now particularly to FIG. 1, there will be seen a perspective view of a person wearing a first embodiment of the subject invention. The person is wearing a pair of pants 10 having conventional outer pockets 12 and a belt 14 passing throughbelt loops 16. A security pocket 18 described in detail hereinafter is hung from the belt 14 by loops 20 which receive the belt 14, pass over the top of the waistband, and extend down into the interior of the pants 10. The security pocket 18 can, of course, be positioned elsewhere on the belt 14 than the position shown, and the word "pants" as used herein is intended to be taken broadly, including, for instance, Bermuda shorts.

The security pocket 18 shown schematically in FIG. 1 is shown in detail in FIGS. 2 and 3. As shown therein, the security pocket 18 comprises a pouch 22 having an opening 24 (not shown in FIG. 3) therein sized to permit access to the interior of the pouch by the hand of the wearer. The loops 20 are attached to the pouch 22 and conveniently may be, as shown, integral extensions of the material of the pouch. In any event, the loops 20, the pouch 22, and the opening 24 are sized and positioned such that articles may be safely stored in the pouch 22 when it is worn within the pants 10 and such that articles can be put into and taken out from the pouch 22 through the opening 24 only from the inside of the pants 10. While the pouch 22 can be suspended from a single loop 20, preferably two loops, spaced from one another sufficiently to permit one loop 20 to be worn on either side of a belt loop 16, are provided. This construction ensures that the pouch 22 will not slide along the belt 14 very far from the desired position.

As shown, the security pocket 18 preferably further comprises means for securely closing the opening 24 in the pouch 22. Such means can comprise a zipper (illustrated in FIG. 2), a button (illustrated in FIG. 4), or even a locking mechanism (not shown).

Figure 9:
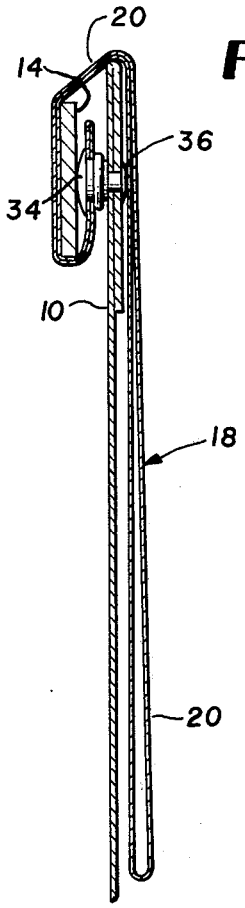
FIG. 9 is a view along the line 9—9 of FIG. 8.
Figure 10:
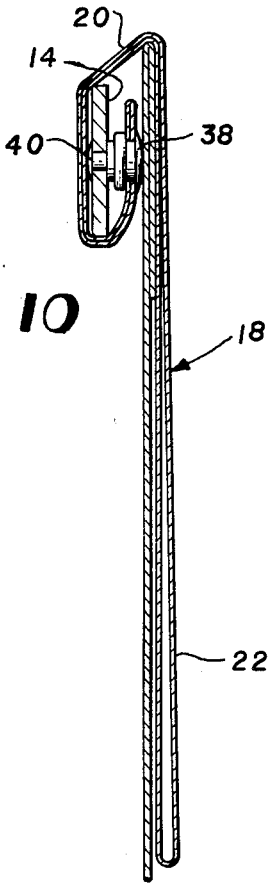
FIG. 10 is a view similar to FIG. 9 of a sixth embodiment of the subject invention.

While the loops 20 can be formed permanently as shown in FIGS. 2 and 3, they are preferably releasably closed to permit removal of the security pocket 18 without having to undo the belt 14. Two embodiments having this feature are shown in FIGS. 8–10. In FIGS. 8 and 9, one portion 34 of a snap or other releasable closing means is carried by one end of the loops 20, the other end of the loops 20 are integral with the pouch 22, and the other portion 36 of the snap or other releasable closing means is carried by the pants 10. In FIG. 10, one portion 38 of a snap or other releasable closing means is carried by one end of the loop 20, the other end of the loop 20 is integral with the pouch 22, and the other portion 40 of the snap or other releasable closing means is carried by the belt 14. In either embodiment, the releasable closing means can be unfastened and the security pocket 18 removed without unfastening the belt 14. It should also be noted that in both of these embodiments one portion of the releasable closing means is carried by a relatively immobile portion of the overall combination (in one embodiment, the pants 10, and, in the other embodiment, the belt 14), preventing the security pocket 18 from moving relative to the belt loops 16.

In addition to security pockets of the general type illustrated in FIGS. 1–3 and 8–10 (i.e., security pockets which are hung from the belt and pass over the top of the waistband), the present invention contemplates a second general type of security pocket in which the pocket is releasably attached to the inside of the pants themselves. Such security pockets are illustrated in FIGS. 4–7, in which the same numbers are used for parts which are the same as in the security pocket illustrated in FIGS. 1–3 and 8–10.

In the embodiments shown in FIGS. 4–7, the pouch 22 is releasably attached directly to the inside of the waistband 26 of the pants 10. In the embodiment shown in FIGS. 4 and 5, the attachment is by snaps 28; in the embodiment shown in FIG. 6, the attachment is by a zipper 30; and in the embodiment shown in FIG. 7, the attachment by buttons 32. In each of the embodiments, as in the previously described embodiments, means are preferably provided for securely closing the opening 24 in the pouch 22.

ADVANTAGES OF THE INVENTION

From the foregoing description of several embodiments of the subject invention, those skilled in the art will recognize several advantages which singularly distinguish the subject invention from previously known security pockets. Some of those advantages are set forth below. However, while the following list of advantages is believed to be both accurate and representative, it does not purport to be exhaustive.

A particular advantage of the subject invention is that it provides security pockets which may be easily removed from the pants when it is desired to carry or store the security pocket separately from the pants.

Another advantage of the subject invention is that it provides security pockets which may be easily removed from the pants when a security pocket is not needed.

CAVEAT

While the present invention has been illustrated by detailed description of several preferred embodiments thereof, it will be obvious to those skilled in the art that various changes in form and detail can be made therein without departing from the true scope of the invention. For that reason, the invention must be measured by the claims appended hereto and not by the foregoing preferred embodiments.

What is claimed is:

1. A security pocket adapted to be worn on the inside of a pair of pants, said security pocket comprising:

a. a pouch having an opening therein sized to permit access to the interior thereof by the hand of the wearer of the security pocket;

b. first means for removably mounting said pouch on the inside of a pair of pants in position such that articles may be safely stored in said pouch and such that articles can be put into and taken out from said pouch through the opening therein only from the inside of the pants, said first means comprising two loops:

(i) attached to said pouch, (ii) sized to receive a belt worn in conventional manner on the outside of the pants, and (iii) spaced from one another sufficiently to permit one to be worn on either side of a belt loop; and c. second means for releasably closing said loops, whereby the security pocket can be removed without having to undo the belt.

2. A security pocket as recited in claim 1 and further comprising third means for securely closing the opening in said pouch.

3. A security pocket as recited in claim 2 wherein said third means comprise a zipper.

4. A security pocket as recited in claim 2 wherein said third means comprise a button.

5. A security pocket as recited in claim 1 wherein said second means is adapted to attach one end of said loops to the wearer's clothing, whereby the security pocket is prevented from moving relative to the belt loop.

6. A security pocket as recited in claim 5 wherein said second means is adapted to attach one end of said loop to the wearer's waistband.

7. A security pocket as recited in claim 5 wherein said second means is adapted to attach one end of said loops to the wearer's belt.

8. A security pocket as recited in claim 1 wherein said second means is a snap.

* * * * *